US005509634A

United States Patent [19]

Gebka et al.

[11] Patent Number: 5,509,634

[45] Date of Patent: Apr. 23, 1996

[54] SELF ADJUSTING GLASS SHELF LABEL HOLDER

[75] Inventors: John Gebka; Michael E. Brinkman, both of Coral Springs, Fla.

[73] Assignee: Femc Ltd., Ft. Lauderdale, Fla.

[21] Appl. No.: 313,830

[22] Filed: Sep. 28, 1994

[51] Int. Cl.[6] ..... A47G 1/10

[52] U.S. Cl. ..... 248/316.7; 248/912; 248/250; 24/336

[58] Field of Search ..... 40/642, 649, 661; 24/336; 248/316.7, 250, 912 CR; 52/716.8, 716.3, 717.03, 717.05, 716.1

[56] References Cited

U.S. PATENT DOCUMENTS

| | | | |
|---|---|---|---|
| 2,705,820 | 4/1955 | Torrence | 52/716.1 |
| 3,456,410 | 7/1969 | Olson et al. | 52/716.8 |
| 4,508,301 | 4/1985 | Nicholson | 248/250 |
| 4,691,887 | 9/1987 | Bessinger | 248/250 |
| 4,765,575 | 8/1988 | Bergl | 248/250 |
| 5,064,158 | 11/1991 | Brazier | 248/250 |

OTHER PUBLICATIONS

Fit–All Pricing Corporation Catalog, pp. 3, 17 and 22; publication date unknown but prior to Sep. 28, 1994.

*Primary Examiner*—Karen J. Chotkowski
*Assistant Examiner*—Gwendolyn Wrenn
*Attorney, Agent, or Firm*—Jacobson, Price, Holman & Stern

[57] ABSTRACT

An extruded PVC clip-on label holder for use on glass shelves such as merchandise shelves in retail outlets has a label holder panel and a pair of resilient rearwardly extending arms forming a channel between which a shelf is gripped. The holder is suitable for use on both thinner and thicker glass shelves by virtue of a step which extends along the base of the channel in one corner. A thinner shelf is gripped between the arms with its front edge fitting over the step and abutting the rear surface of the label holder panel. A thicker shelf is gripped between the arms with its front edge abutting the step.

8 Claims, 2 Drawing Sheets

SELF ADJUSTING GLASS SHELF LABEL HOLDER

BACKGROUND OF THE INVENTION

This invention relates to a holder of the kind which clips onto the front edge of a shelf, such as a merchandise display shelf in a retail outlet, to carry a label for providing information relating to the merchandise on the shelf. The invention is particularly concerned with label holders for use on plane glass or like shelves.

Label holders for use on glass shelves need to provide an effective grip on the smooth glass surfaces so as not to be easily dislodged use. Also, glass shelves used in many retail outlets come in different thicknesses, so that it is advantageous to have a label holder which can accommodate itself to different thickness shelves while still maintaining an effective grip on each such shelf.

SUMMARY OF THE INVENTION

It is an object of the invention to provide a label holder for glass and like shelves, which is designed for use with shelves of respectively different thicknesses, and which provides an effective grip on each such shelf.

In accordance with the invention, therefore, at least in a preferred embodiment, a label holder, preferably formed by extrusion in a clear plastic such as PVC comprises a label holder panel with a front surface for receiving a label and a rear surface with a pair of rearwardly extending resilient arms defining a grip therebetween in the form of a channel for clipping the holder onto a shelf. Further, along the base of the channel in one corner, there is formed a step having substantially perpendicular faces extending respectively from the label panel and from one of the arms.

The label holder is designed for use, with glass shelves of two different thicknesses, for example shelves of 0.25" thickness and shelves of 0.375" thickness which are both common in retail outlets. The thinner shelf fits between the arms of the holder and over the step so that the front edge of the shelf butts against the back of the label holder panel. The thicker shelf on the other hand fits between the arms, which spread more widely to accommodate the shelf, and butts against the step. In both cases the holder provides an effective grip as will be described.

The front face of the label holder panel may be provided with any convenient form of label attaching means or may be devoid of same, if self-adhesive labels are to be used.

DESCRIPTION OF THE PREFERRED EMBODIMENT

Figure 1:
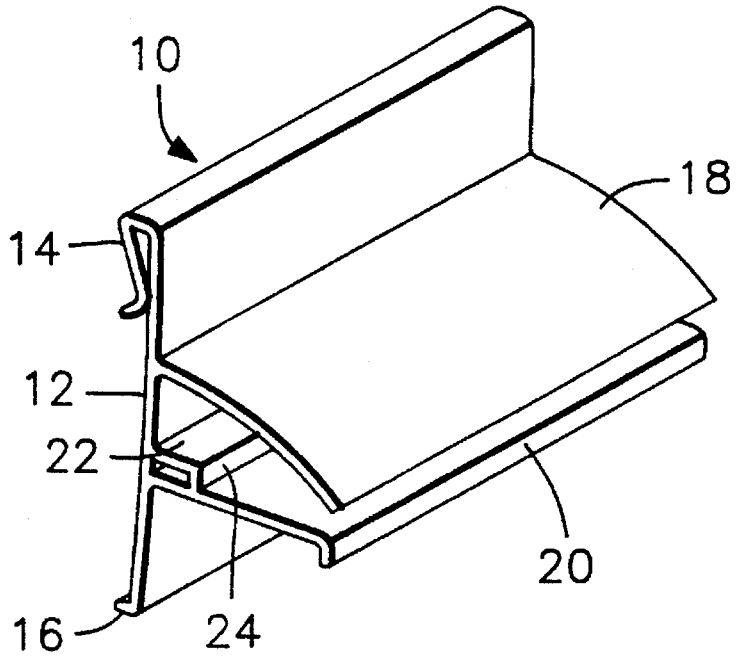
FIG. 1 is a perspective view of a label holder according to the invention.

A label holder 10, as shown in FIGS. 1 to 5 is formed as a clear PVC extrusion with a label panel 12 having a front surface with a resilient hook 14 along its upper edge and a lip 16 along its lower edge for receiving a non-adhesive label card therebetween. As previously stated, the hook and lip are exemplary only of suitable label attaching means and alternative means can be used.

Extending from the rear surface of the label holder panel are upper and lower resilient arms 18, 20 defining therebetween a grip in the form of a channel whereby the holder can be clipped onto a glass shelf. Also, extruded along the base of the channel is a step having one face 22 extending from the label holder panel 12 and a perpendicular face 24 extending from arm 20. The dimensions of the channel and of the step are designed to permit the holder effectively to grip on two different thickness shelves.

Figure 2:
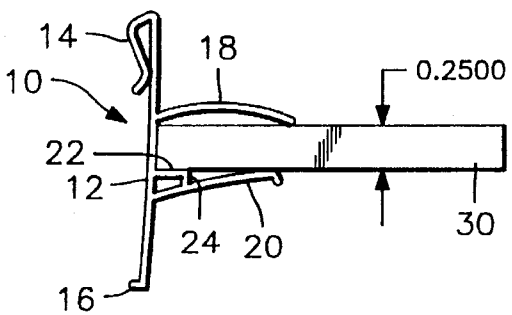
FIG. 2 a side elevational view of the label holder clipped onto a thin glass shelf.
Figure 3:
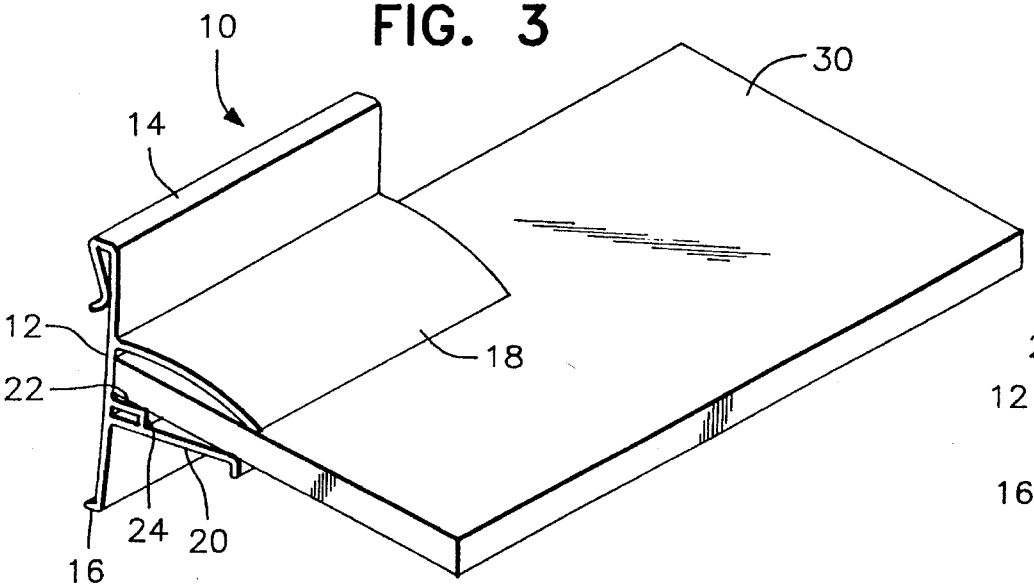
FIG. 3 is a perspective view of the label holder and thin glass shelf.

Thus, for a thinner shelf 30, e.g., a shelf of 0.25" thickness, as shown in FIGS. 2 and 3, the shelf fits between arms 18, 20, over face 22 of the step and butts with its front edge against the label holder panel 12 at the base of the channel. In this case, the shelf is gripped between the end of upper arm 18, face 22 of the step and the free end of arm 20.

Figure 4:
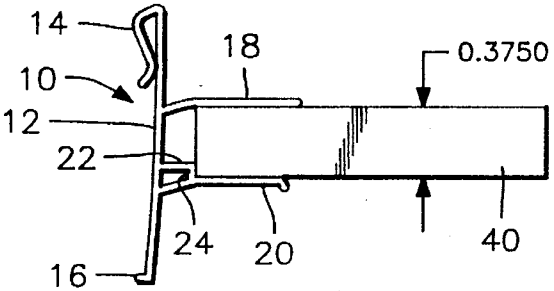
FIGS. 4 and 5 are views similar to FIGS. 2 and 3 but showing the label holder clipped onto a thicker glass shelf.
Figure 5:
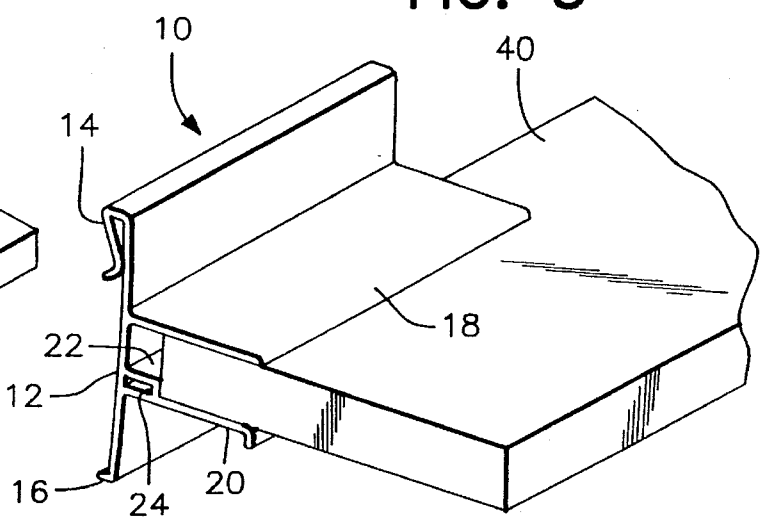

For a thicker shelf 40, e.g., a shelf of 0.0375" thickness, as shown in FIGS. 4 and 5, the shelf fits between arms 18 and 20, which open more widely and butts with its front edge against face 24 of the step. In this case, the shelf is gripped between the arms 18, 20 substantially throughout their length. In both cases, the shelf is firmly gripped by the resilient arms and the holder is properly aligned by abutment of the front edge of the shelf either against the back of the label holder panel or against face 24 of the step.

Figure 6:
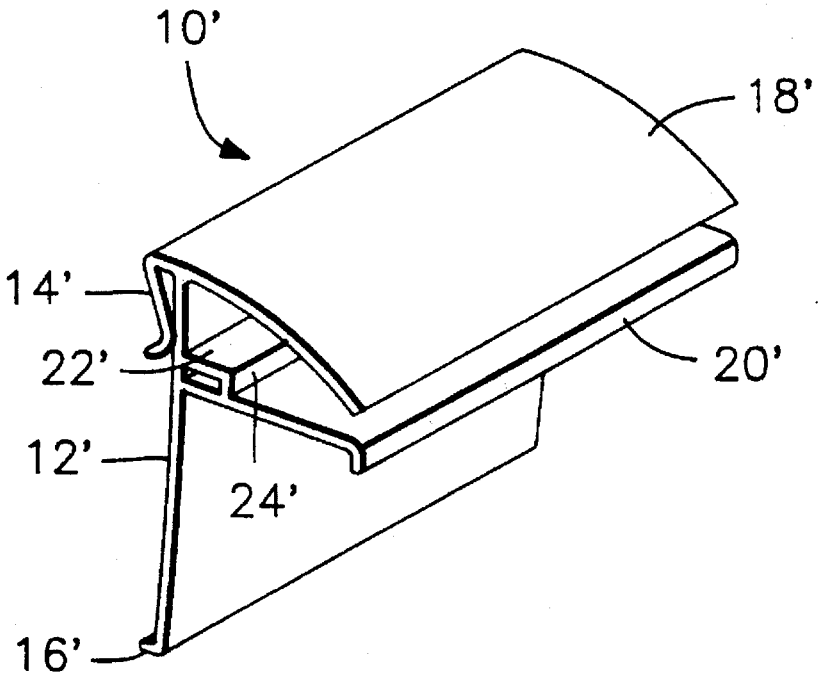
FIG. 6 is a perspective view of a modified embodiment.

FIG. 6 shows a modified form of label holder 10' in which the arms 18', 20' are at the top of the label holder panel with arm 18 forming a rearward extension of hook 14'. With this design, the label holder panel hangs down from a shelf, leaving its top surface unobstructed.

While only preferred embodiments of the invention have been described herein in detail, the invention is not limited thereby and modifications can be made within the scope of the attached claims.

We claim:

1. A label holder for attachment to a shelf comprising a label holder panel having a front surface for receiving a label and a rear surface having a pair of rearwardly extending resilient arms defining a grip therebetween in the form of a channel for clipping the holder onto the shelf, and a means for alternately gripping two different thicknesses of shelves, wherein said means comprises a step extending along a base portion of the channel in one corner thereof wherein the step has a first face extending from the label holder panel and a second face perpendicular to the first face extending from one of said arms.

2. A label holder as claimed in claim 1, comprising a plastic extrusion.

3. A label holder as claimed in claim 1, including label attachment means on the front surface of the label holder panel.

4. A label holder as claimed in claim 3, wherein the label attachment means comprises a resilient hook along one edge of the label holder panel and a lip along an opposite edge of the label holder panel.

5. A label holder as claimed in claim 1, wherein the arms are spaced inwardly from upper and lower edges of the label holder panel.

6. A label holder as claimed in claim 1, wherein one of the arms extends from an upper edge of the label holder panel.

7. A label holder as claimed in claim 1, in combination with a shelf onto which the label holder is clipped with the front edge portion of the shelf between the arms of the holder and a front edge of the shelf abutting the rear surface of the label holder.

8. A label holder as claimed in claim 1, in combination with the shelf onto which the label holder is clipped with a front edge portion of the shelf received between the arms of the holder and a front edge of the shelf abutting one face of the step.

* * * * *